United States Patent [19]

Harden

[11] 4,195,767

[45] Apr. 1, 1980

[54] PEG BOARD SCORING DEVICE

[76] Inventor: Dale R. Harden, 30 Briarwood, Pontiac, Mich. 48055

[21] Appl. No.: 970,970

[22] Filed: Dec. 19, 1978

[51] Int. Cl.[2] ..... A63F 1/18

[52] U.S. Cl. ..... 235/90

[58] Field of Search ..... 235/90; 116/325, 222; 273/148 R, 154, DIG. 26

[56] References Cited

U.S. PATENT DOCUMENTS

| | | | |
|---|---|---|---|
| 557,205 | 3/1896 | Hinckley | 273/148 R |
| 1,168,374 | 1/1916 | Barker | 235/90 |
| 2,162,631 | 6/1939 | McOsker | 235/90 |
| 2,432,167 | 12/1947 | Manuel | 235/90 |
| 2,434,495 | 1/1948 | Holton | 235/90 |
| 3,695,512 | 10/1972 | Trudel | 235/90 |

FOREIGN PATENT DOCUMENTS

| | | | |
|---|---|---|---|
| 367956 | 3/1932 | United Kingdom | 235/90 |

*Primary Examiner*—Stephen J. Tomsky
*Attorney, Agent, or Firm*—Basile and Weintraub

[57] ABSTRACT

A peg board scoring device for scoring the game of euchre is disclosed. A first plurality of spaced apart apertures are disposed in a base along a first pair of converging lines intersecting to form a "V". A second plurality of spaced apart apertures in the base are disposed along a second pair of lines converging to form a mirror image of the first pair of converging lines. The intersection of the first pair of lines and the intersection of the second pair of lines are spaced apart a distance. The first and second pairs of spaced apart apertures are used by opposing players to score a game euchre. A third plurality of evenly spaced apart apertures extends inward from a left edge of the base perpendicular to the edge to provide a device for one of the players to score the games he has won. A fourth plurality of evenly spaced apertures extending inward from the right edge of the base is used by the second player to score the games won by him. A storage container with a slidable cover is used for storing the pegs when not in use. Indicia on the surface of the base denote the start and finish position for each of the opposing players.

7 Claims, 2 Drawing Figures

PEG BOARD SCORING DEVICE

BACKGROUND OF THE INVENTION

I. Field of the Invention

The present invention relates to the field of peg board scoring devices and particularly to the field of peg boards scoring devices for scoring the game of euchre. More particularly the present invention relates to the field of peg board scoring devices for scoring the game of euchre wherein the board has one row of holes for each opposing player each players series of holes arranged in a "V" with the intersection of the "V" pointing toward the center of the board.

II. Prior Art Statement

Peg boards for scoring games such as cribbage have long been known. Players of the game of euchre usually have used a peg board designed for the game of cribbage to score the game. Cribbage boards have the disadvantage of containing far too many holes for the game of euchre, and while the game can be scored using a cribbage board, mistakes can often be made, and it is difficult to tell at a glance the relative standing of opposing players. U.S. Pat. Nos. 2,432,167; 2,434,495; and 3,695,512 are illustrative of peg board scoring devices used in scoring the game of cribbage. U.S. Pat. No. 2,432,167 discloses a cribbage board which can be conveniently used for more than two players. The board can be unfolded in such a way that the rows of holes for each of three players are arranged in a "Y" formation. U.S. Pat. No. 2,434,495 illustrates a peg board scoring device for scoring cribbage with three opposing players wherein the rows of holes for the players are arranged in a triangular shape. In the event that only two players are playing, the board can be folded so that only two rows of scoring holes are provided in the more or less conventional manner. U.S. Pat. No. 3,695,512 discloses a conventional cribbage peg board scoring device with the scoring holes arranged in a conventional manner. The peg board device is of laminated construction with felt or some other form of resilient layered material disposed between rigid portions. The purpose of the flet is to impart a satisfactory feel to the pegs as they are inserted or withdrawn and to aid in preventing the sticking of the pegs in the holes. The games won portion of the cribbage board of U.S. Pat. No. 3,695,512 comprises a pair of converging lines of holes with the holes arranged in groups of five.

None of the above listed U.S. Patents describes nor anticipates the present invention. The above listed U.S. Patents constitute the entire prior art known to the Inventor and his Attorney.

SUMMARY OF THE INVENTION

Euchre players ideally require for scoring purposes a peg board containing ten holes for each player to constitute a game. Cribbage boards are arranged with rows of holes in groups of five so that a euchre player using a cribbage board would be required to complete two rows of five holes to score a game. The cribbage board contains a much larger number of holes than required to complete a euchre game. The holes in a cribbage board are of necessity closely spaced because of the large number of holes required. This increases the chance of an error being commited during the scoring.

The present invention comprises a first plurality of spaced apart apertures in a base which are disposed along a first pair of converging lines which intersect to form a "V". A second plurality of spaced apart apertures in the base are disposed along a second pair of converging lines to form a mirror image of the first pair of converging lines. The intersection of the first pair of lines and the intersection of the second pair of lines are spaced apart a distance to avoid confusion between the scoring position of opposing players. A first plurality of spaced apart apertures and the second plurality of spaced apart apertures each contain ten apertures which comprises a game in the game of euchre. The point where the converging lines meet is where the sixth aperture is placed in each group of ten apertures so that opposing players and observers can easily ascertain the standing of each player within a game. A third row of five apertures disposed in a line perpendicular to the left side of the board is provided to allow a first player to score the number of games won. A fourth plurality of five apertures is disposed in a line perpendicular to the right edge of the base to permit a second player to score the number of games won. A chamber within the base is provided for storing the pegs when not in use. The storage chamber has a sliding cover to secure the pegs within the base.

Other objects, advantages, and applications of the present invention will become apparent to those skilled in the art of peg board scoring devices for the game of euchre when the accompanying description of one example of the best mode contemplated for practing the invention is read in conjunction with the accompanying drawing.

BRIEF DESCRIPTION OF THE DRAWINGS

The description herein makes reference to the accompanying drawings wherein like reference numbers refer to like parts throughout the several views, and wherein.

DESCRIPTION OF THE PREFERRED EMBODIMENT

Figure 1:
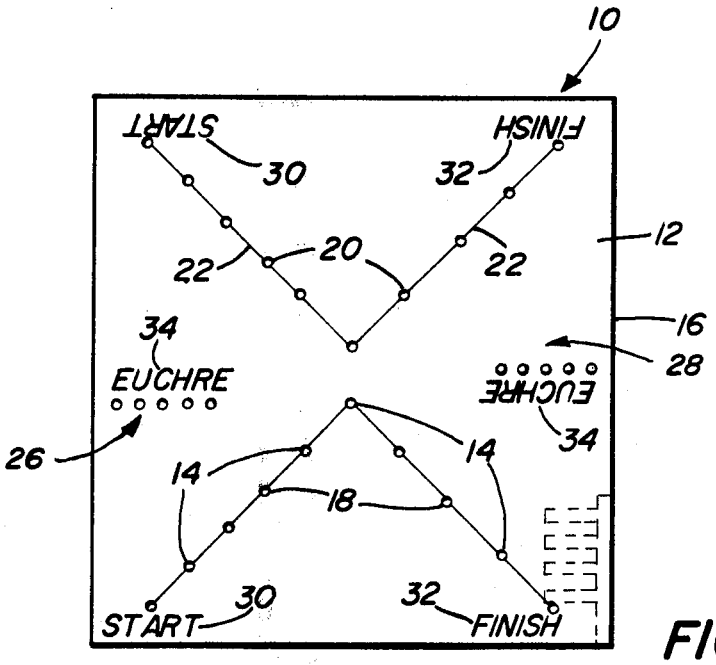
FIG. 1 illustrates a plan view of the preferred embodiment of the present invention.

Referring now to the drawings and in particular to FIG. 1 wherein there is illustrated at 10 a preferred embodiment of the present invention at 12 comprising a peg board scoring device for scoring the game of euchre. The euchre peg board scoring device 12 comprises a first plurality of spaced apart apertures 14 in a base 16 disposed along a first pair of converging lines 18 intersecting to form a "V". The first plurality of spaced apart apertures contains ten spaced apertures. A starting aperture 14 is disposed at the lower left corner of the base 16 along the line 18. A second plurality of spaced apertures 20 containing ten apertures, are disposed along a second pair of converging lines 22 to form a mirror image of the lines 18. A starting aperture 20 is disposed at the upper right hand corner of the base along the line 22. The intersection of the first pair of lines and the intersection of the second pair of lines are spaced apart a distance to avoid confusing the first and second plurality of spaced apertures. The line 18 and the line 22 containing the starting apertures 14 and 20 each contain six apertures, the sixth aperture at the intersection of the lines 18 or 20. The remaining four apertures making a total of ten are spaced along the other converging lines 18 and 22. The base 16 has a proximate rectangular shape with the first aperture 14 beginning spaced in a distance from one of the corners. The last aperture 14 is spaced in a distance from a second corner of the base 16. The first aperture 20 begins a distance spaced in from a third corner of the base 16 and the last aperture 20 is disposed a distance spaced in from a fourth corner of the base 16. The base 16 has sufficient thickness to accommodate the apertures 14 and 20 and slidingly support pins 24 within the apertures 14 and 20 without having the apertures 14 and 20 extend through the thickness of the base 16. A pair of pegs 24 are slidingly received by the plurality of apertures 14 and the plurality of apertures 20. A third plurality of evenly spaced apertures 26 containing five apertures extend inward from a left edge of the base along a line perpendicular to the edge of the base aligned with the intersection of the first plurality of apertures. The third plurality of apertures 26 serves as a means for scoring the number of games won by a first player, who does his scoring within a game using the plurality of apertures 14. A fourth plurality of evenly spaced apertures 28 containing five evenly spaced apertures, extends inward from the right edge of the base perpendicular to the right edge, disposed along a line perpendicular to the right edge and in line with the intersection of the plurality of apertures 20. The fourth plurality of apertures 28 is used to score the games won by a second player who scores within a game along the plurality of apertures 20.

Indicia are provided to indicate start 30 and finish 32 positions for the first player. The start indicia 30 is disposed at the lower left hand corner of the board for the first player and the finish indicia 32 for the first player is disposed at the lower right hand corner. Indicia 30 for the second player is disposed at the upper right hand corner of the board, and the second players finish indicia 32 is disposed at the upper left hand corner of the board. Indicia with the word euchre 34 is disposed above the third plurality of evenly spaced apertures running parallel to the apertures, and indicia with the word euchre is disposed above the fourth plurality of evenly spaced apertures 28 running parallel to the fourth apertures and spaced slightly above the apertures 28. In each case the indicia is disposed so that the words start, finish, and euchre are properly oriented for players to read who are positioned on opposite sides of the board.

Figure 2:
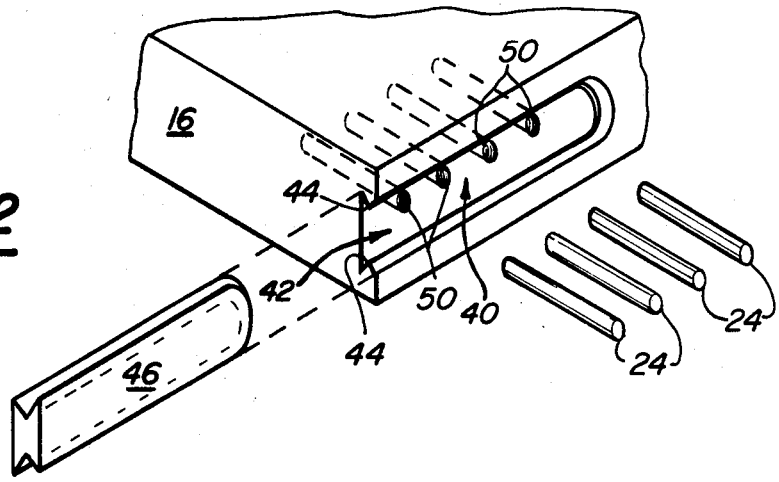
FIG. 2 illustrates a broken perspective view of a corner of the base providing means for storing the pegs when not in use.

Referring now to FIG. 2 wherein there is illustrated a means for storing the pegs 24 within the base 16 when not in use. The storage means 40 comprises a groove cut along one edge of the base 16 beginning at a corner and extending a distance along a side of the base 16. The groove 42 has parallel upper and lower edges with inwardly projecting "V" shaped points. The "V" shaped points 44 serve as a means for retaining a slidable cover 46. The slidable cover 46 has a cross-section slightly less than but identical in shape to the cross-section of the groove 42 so that the slidable cover 46 is slidable into the groove 42. The inward end of the groove 42 has a half round radius as would be formed by a routing tool used to form the groove. The inward end of a slidable cover 46 has a half round end matching the end of the groove 42. A plurality of apertures 50 are disposed in the bottom of the groove 42 and are configured to loosely receive the plurality of pegs 24. When the pegs 24 have been inserted into the apertures 50 the cover 46 is slidingly inserted into the groove 42 securely retaining the pegs 24 within the base 16.

The base 16 can be formed from wood products, injection molded plastic, papier mache or metal. In deluxe versions of the scoring device the indicia can be inlaid ivory and the board can be made from luxury wood such as cherry, mahogany, or the like. The pegs 24 can be made of molded plastic, brass or steel rods cut to length, or any of a variety of suitable materials.

The scoring device hereinabove provides a simple and easily used device for scoring the game of euchre wherein players or observers can quickly ascertain the status of the game even from a substantial distance.

Having thus described my invention what I claim is:

1. A peg board scoring device comprising:

a rigid base;

a first plurality of ten spaced apart apertures in the base disposed along a first pair of converging lines intersecting to forming a "V";

one of said converging lines designated as "start" containing six apertures, the sixth aperture disposed where the lines intersect;

another of said converging lines designated "finish" containing four apertures spaced from the sixth aperture and alinged therewith;

a second plurality of spaced apart apertures in the base disposed along a second pair of converging lines forming a mirror image of the first pair of converging lines; and the intersection of the first pair of lines and the intersection of the second pair of lines spaced apart a distance.

2. The scoring device as defined in claim 1 further comprising a first pair of pegs to slidingly engage each of the first and second pairs of apertures, said first pair of pegs having sufficient length when inserted to project above a surface of the base a distance.

3. The scoring device as defined in claim 1 further comprising:

a third plurality of evenly spaced apertures extending inward from a left edge of the base, perpendicular to said left edge and in line with the intersection of the first plurality of apertures; and a fourth plurality of evenly spaced apertures extending inward from a right edge of the base, perpendicular to said right edge and in line with the intersection of the second plurality of apertures.

4. The scoring device as defined in claim 3 further comprising five apertures in each of the third and fourth plurality of apertures.

5. The scoring device as defined in claim 4 further comprising a second pair of pegs to slidingly engage the third and fourth plurality of apertures said second pair of pegs having sufficient length when inserted to project above the surface of the base.

6. The scoring device as defined in claim 5 further comprising:

indicia denoting "START" at one end of each of the first and second plurality of apertures and "FINISH" at the other end of each of the first and second plurality of apertures; and indicia denoting "EUCHRE" above each of the third and fourth plurality of apertures.

7. The scoring device as defined in claim 2 further comprising means for storing the first and second pairs of pegs.

* * * * *